United States Patent [19]

Bower

[11] 4,244,675

[45] Jan. 13, 1981

[54] MULTI-STAGE BARREL TYPE CENTRIFUGAL PUMP WITH RESILIENT COMPENSATOR MEANS FOR MAINTAINING THE SEALS BETWEEN INTERSTAGE PUMPING ASSEMBLIES

[75] Inventor: John R. Bower, Newark, England

[73] Assignee: Worthington Pump, Inc., Mountainside, N.J.

[21] Appl. No.: 34,634

[22] Filed: Apr. 30, 1979

[51] Int. Cl.[3] ..... F01D 25/24; F04D 1/06

[52] U.S. Cl. ..... 415/135; 415/199.1

[58] Field of Search ..... 415/199.1, 199.2, 199.3, 415/134, 135, 219 C, 219 R

[56] References Cited

U.S. PATENT DOCUMENTS

| | | | |
|---|---|---|---|
| 2,017,544 | 10/1935 | McHugh | 415/134 |
| 3,010,697 | 11/1961 | Lazo et al. | 415/135 |
| 3,676,013 | 7/1972 | Albertson | 415/199.2 X |
| 3,801,217 | 4/1974 | Ryall et al. | 415/199.2 |
| 4,098,558 | 7/1978 | Bush | 415/199.1 |

FOREIGN PATENT DOCUMENTS

| | | | |
|---|---|---|---|
| 732293 | 6/1955 | United Kingdom | 415/199.2 |

*Primary Examiner*—Leonard E. Smith
*Attorney, Agent, or Firm*—Daniel H. Bobis

[57] ABSTRACT

A compensator for differential thermal expansion in a multi-stage barrel type centrifugal pump has a truncated conical body section and a plurality of leaf springs extending radially from said body section, the compensator is disposed in the multi-stage barrel type centrifugal pump between the outer casing and the end most interstage pumping assembly of a plurality of serially disposed interstage pumping assemblies in the centrifugal pump so that it is biased by the leaf springs to exert a controlled force in the direction of the end most interstage pumping assembly to permit movement between the serially disposed interstage pumping assemblies with variations in temperature arising during the operation of the centrifugal pump while continuing to maintain a tight seal between these respective interstage pumping assemblies.

12 Claims, 3 Drawing Figures

MULTI-STAGE BARREL TYPE CENTRIFUGAL PUMP WITH RESILIENT COMPENSATOR MEANS FOR MAINTAINING THE SEALS BETWEEN INTERSTAGE PUMPING ASSEMBLIES

BACKGROUND OF THE INVENTION

This invention relates generally to multi-stage barrel type centrifugal pumps having a plurality of interstage pumping assemblies wherein the components are made of dissimilar materials so connected and disposed that during the operation of such pumps relative movement occurs in the interstage pumping assemblies with variations in temperatures and more particularly to a compensator for differential expansion in such centrifugal pumps adapted to permit relative movement between such interstage pumping assemblies while maintaining tight seals between adjacent interstage pumping assemblies.

Multi-stage barrel type centrifugal pumps include, an outer cylindrical or barrel type casing closed at one end by a first end casing and at the opposite end by a second end casing. A shaft extends end to end through the centrifugal pump along the longitudinal axis thereof and mounted on said shaft and in the outer casing are a plurality of serially connected interstage pumping assemblies the first of which communicates with and receives fluid to be pumped from an inlet generally in the first end casing and the end most or last of which interstage pumping assemblies communicates with a discharge outlet which can also be disposed in the first end casing, for delivering the pumped fluid from the centrifugal pump.

Multi-stage barrel type centrifugal pumps of the type above described are well known to those skilled in the art.

It is also known that the components and elements of such multi-stage barrel type centrifugal pumps are made of dissimilar materials. Hence in the operation of these pumps particularly when handling liquids at elevated temperatures forces are set up between the elements and components due to differential expansion which occurs with variations in temperatures of the liquids being pumped. If these forces are not restrained to some degree faulty pump performance may result. If restrained to severely excessive stresses in one or the other of the elements or components ultimately results in a failure of one or more of such components.

Further in the operation of multi-stage barrel type centrifugal pumps the interstage pumping assemblies expand differently compared with the surrounding outer casing and as a result there is a reduction in the tightness of the seals between such interstage pumping assemblies.

Heretofore the prior art have overcome this reduction in sealing tightness between interstage pumping assemblies in these centrifugal pumps by providing a sliding joint between the interstage pumping assemblies but it has been found that such sliding joints are susceptible to failure because of local corrosion or due to the accumulation of dirt between the coacting faces of the sliding joints.

Certain prior art shows means for excerting controlled axial forces against the interstage pumping assemblies for purposes non-analogous to those in the present invention as is indicated by U.S. Pat. Nos. 4,098,558 and 3,801,217.

The present invention seeks to provide an improved means for overcoming the above outlined problem in multi-stage barrel type centrifugal pumps by utilizing a compensator for this differential expansion which is capable of undergoing resilient displacement and which can be positioned in the centrifugal pumps between the outer casing and the interstage pumping assemblies so as to permit differential movement to occur between the interstage pumping assemblies while still exerting a controlled force between these interstage pumping assemblies so as to maintain the seals therebetween.

SUBJECT MATTER OF THE INVENTION

Thus the present invention covers a compensator for differential expansion and multi-stage barrel type centrifugal pumps comprising a truncated conical element and a plurality of resilient elements which act to spring bias the compensator in assemblied position in the centrifugal pump to maintain a fluid tight seal between the interstage pumping assemblies in the centrifugal pump.

Preferably the resilient element of the compensator consists of a plurality of leaf springs which are radially disposed to extend from the central portion of the truncated conical element outward therefrom and the truncated conical element can be made lighter by providing a plurality of circumferentially spaced holes or openings through the side walls thereof which also function to pass fluid therethrough to the discharge outlet for the centrifugal pump.

Accordingly it is an object of the present invention to provide a compensator for differential expansion in a multi-stage barrel type centrifugal pump so as to maintain the seals between interstage pumping assemblies therein.

It is another object of the present invention to provide a relatively light strong and resilient compensator which can be biased to exert a controlled force on the interstage pumping assemblies in a multi-stage barrel type centrifugal pump so as to permit movement therebetween while maintaining a tight seal between the successive or serially disposed interstage pumping assemblies.

With this and other objects in view the invention is best understood with reference to the accompanying description taken with the drawings in which.

Figure 1:
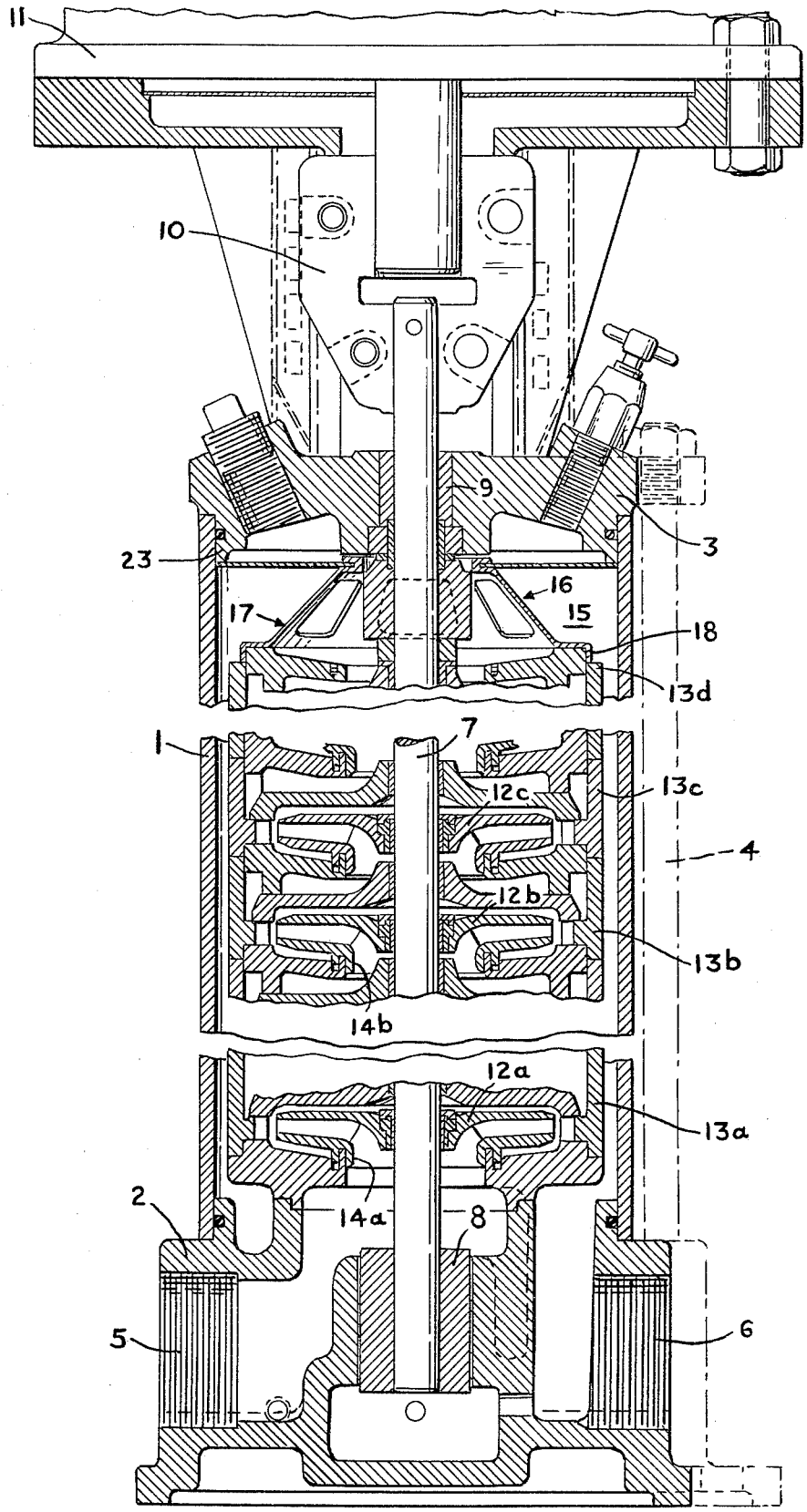
FIG. 1 shows a multi-stage barrel type centrifugal pump in vertical section showing a preferred form of compensator in accordance with the present invention.

Referring to the drawings FIG. 1 shows a multi-stage barrel type centrifugal pump P in the vertically oriented position for in line connection in a pumping system having an outer cylindrical casing 1, a lower end casing 2 closing one end thereof and an upper end casing 3 closing the upper or remote end of the outer casing or barrel 1. The outer cylindrical casing 1, the lower end casing and upper end casing are held together by tie bolts 4 in the conventional manner.

The lower end casing includes a suction inlet as at 5 and a discharge outlet as at 6 which are disposed in alignment with each other to facilitate connecting the multi-stage barrel type centrifugal pump P into the pumping system in which the pump is utilized.

Extending end to end through the pump P is a driven shaft 7 which is disposed for rotation in a lower bearing 8 and an upper bearing 9 all of which is shown in FIG. 1 of the drawings.

The driven shaft 7 is connected through coupling 10 to any suitable driving means generally designated 11 which can be for example an electric motor.

Connected about the shaft 7 are a plurality of impellers 12*a*, 12*b* and 12*c* which impellers form part of a plurality of interstage pumping assemblies which are disposed in serial alignment about the shaft 7 as at 13*a*, 13*b*, 13*c* and 13*d* so that the interstage pumping assembly define an inner casing which lies within and spaced from the inner wall of the outer cylindrical casing or barrel 1. The suction eye or inlet 14*a* for the impeller 12*a* communicates with the inlet 5 so that fluid delivered to the inlet 5 can pass into the impeller 12*a*. The impeller 12*a* delivers the fluids through the interstage pumping assembly 13*a* to the suction eye 14*b* of the next successive impeller 12*b* and the fluid being pumped is then serially passed from interstage pumping assembly until it reaches the end most or last interstage pumping assembly 13*d* where it passes as hereinafter described to the space 15 between the interstage pumping assemblies and the outer casing 1 where it flows downwardly to the discharge outlet 6 for return to the pumping system in which the centrifugal pump P is connected.

The construction and operation of multi-stage barrel type centrifugal pumps of the type shown and described are well known to those skilled in the art and hence are not more fully described herein.

Where such pumps are pumping fluids at high pressures and high temperatures, the interstage pumping assemblies will be subjected to stresses and strain which cause movement therebetween due to the differential expansion of the elements of the interstage pumping assemblies and the relative expansion of the interstage pumping assemblies themselves in respect of or relative to the outer cylindrical casing 1.

In accordance with the present invention this is restrained or relieved by means of an element which is capable of undergoing resilient displacement so positioned with respect to the interstage pumping assembly as to permit differential movement to occur between the interstage pumping assemblies but at the same time will exert a uni-directional control force against the interstage pumping assemblies for maintaining the seals therebetween as will now be described.

Thus FIG. 1 shows a compensator generally designated 16 which is disposed between the upper end casing 3 and the last or upper most interstage pumping assembly 13*d*.

The compensator 16 includes a generally frustro conical main body section or pre load cone 17 which has the larger end of the cone facing towards the last or upper most interstage pumping assembly 13*d*. About the lower or large end of the frustro conical body element 16 is a peripherially and axially extending flange 18 which is sized to engage about the upper most end of the interstage pumping assembly so as to maintain the compensator in axial alignment with the interstage pumping assemblies and in assembled position relative thereto all of which is shown is FIGS. 1, 2 and 3 of the drawings.

Figure 2:
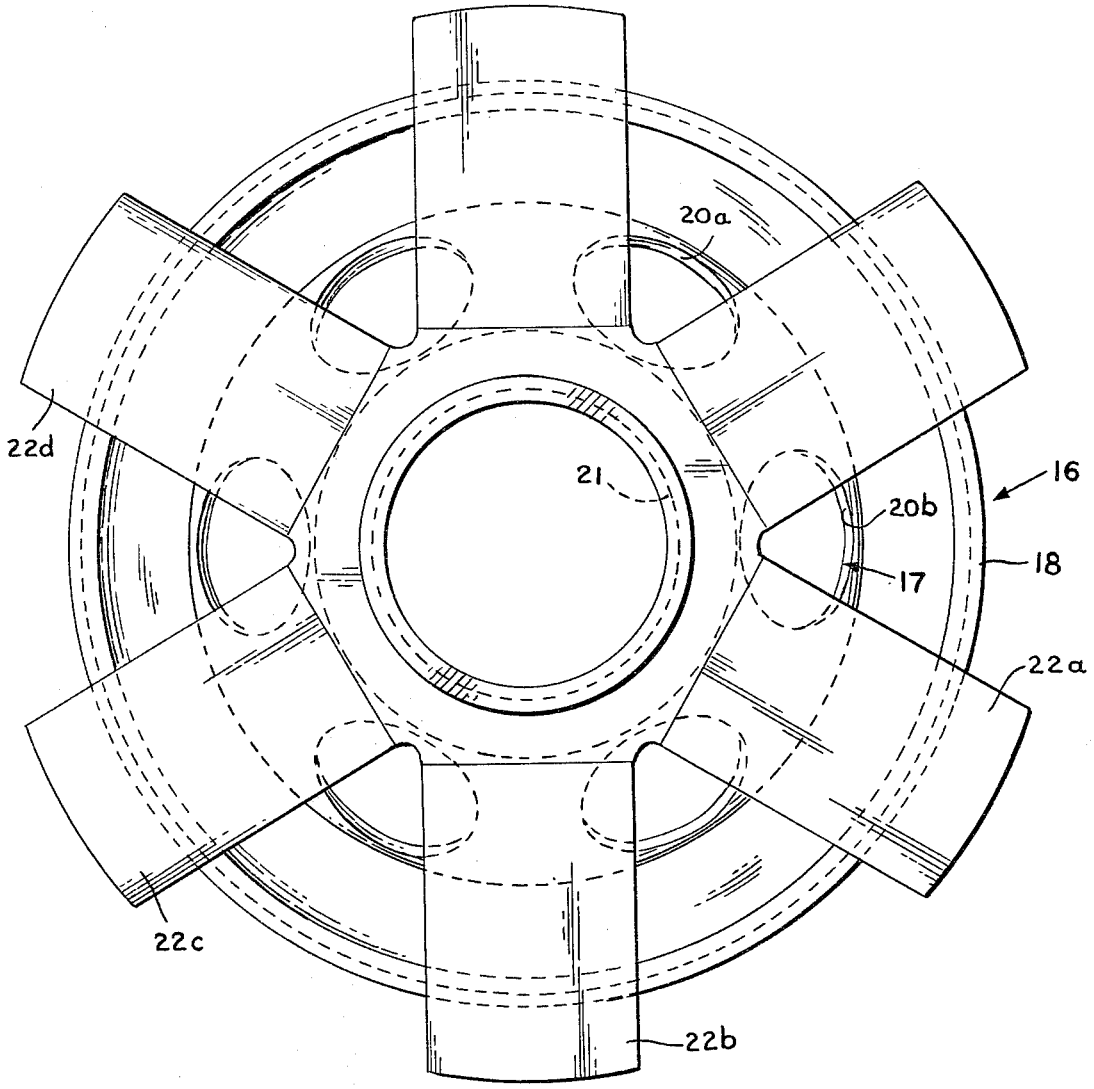
FIG. 2 is a top plan view of the compensator shown in FIG. 1.
Figure 3:
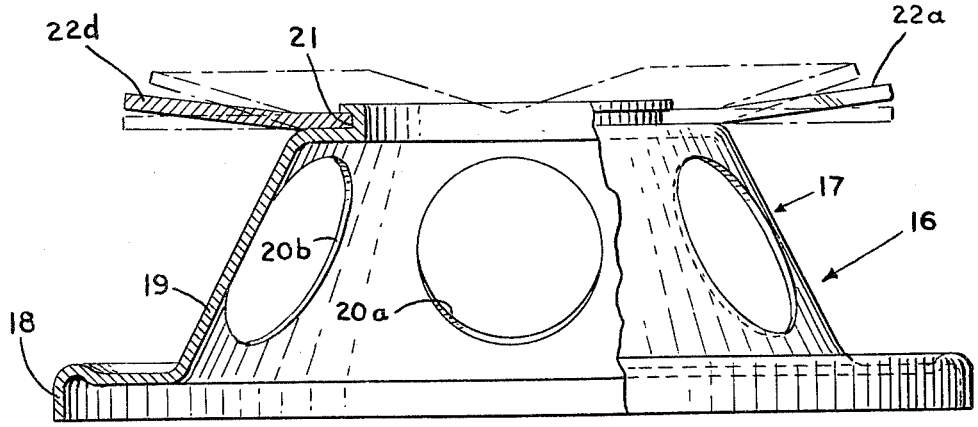
FIG. 3 is a side view in partial vertical section of the compensator shown in FIG. 1 showning the leaf spring in phantomized form in the biased position.

FIGS. 1, 2 and 3 further show that the wall 19 of the frustro conical main body element 17 has a plurality of openings 20*a*, 20*b* etc. formed therethrough in circumferentially spaced relation and these openings communicate with the discharge outlet of the end most or last stage 13*d* so as to pass fluid from the interstage pumping assemblies therethrough to the space 15 between the interstage pumping assemblies and the outer cylindrical casing 1 of the centrifugal pump P.

At the upper end of the frustro conical main body element 17 remote from the flange end a circular groove or channel is formed as at 21 and mounted in the circular groove are a plurality of leaf spring as at 22*a*, 22*b*, 22*c* and 22*d* etc. which extend radially outward away from the central portion and the circular groove 21 at the upper end of the frustro conical main element or pre load cone 17 of the compensator 16.

The leaf springs are normally disposed so that they lie at an angle to the transverse or horizontal plane through the circular groove 21 as is clearly shown by the solid lines in FIG. 3 of the drawings. When the compensator is placed into assembled position so as to engage the flange 23 formed on the inner face of the end casing 3, the leaf springs will bias the compensator 16 so as to exert a controlled force against the end most or upper most interstage pumping assembly 13*d* in a direction towards the lower or inlet and discharge end of the centrifugal pump P. This loading will be transmitted to the various interstage pumping assemblies because of their serial contact with respect to each other and therefore will force the interstage pumping assemblies into tight engagement with each other. Such engagement will be maintained regardless of the differential expansion that may occur between the elements and components of the interstage pumping assemblies or between the interstage pumping assemblies and the outer cylindrical casing 1.

Thus a simple element or unit capable of undergoing resilient displacement serves to permit differential movement to occur between the interstage pumping assemblies while maintaining a controlled force between these interstage pumping assemblies so as to maintain the seal between the respective assemblies.

It will be understood that the invention is not to be limited to the specific construction or arrangement of parts shown but that they may be widely modified within the invention defined by the claims.

What is claimed is:

1. A compensator for maintaining the seals between interstage pumping assemblies of a multi-stage barrel type centrifugal pump comprising, a. a main body element having annular means at one end for engaging the last one of said interstage pumping assemblies radially outward of the centerline thereof to maintain concentricity of the compensator with respect to said interstage pumping assemblies when the compensator is exerting forces thereon, b. resilient means connected at the end of said main body element remote from said annular means, and c. said resilient means biased in assembled position to exert a controlled force on said annular means to permit differential movement of said interstage pumping assemblies while maintaining a fluid tight seal between the respective interstage pumping assemblies.

2. A compensator as claimed in claim 1 wherein, a. said main body element has a truncated conical shape, and b. said resilient means is a plurality of radially disposed leaf springs which are connected at their inner ends to the main body element about the upper end thereof.

3. A compensator as claimed in claim 1 wherein, a. said main body element has a truncated conical shape, b. the lower end of said main body element has a peripheral and axially extending flange adapted in assembled position to engage the last of said interstage pumping assemblies, and c. said resilient means are a plurality of leaf springs having their inner ends connected to said main body element at a point remote from said flanged end and extend radially outward from said inner ends, and d. said leaf springs normally in the unbiased position extending above the plane transverse to the upper end of said compensator.

4. A compensator as claimed in claim 1 wherein, a. said main body element has wall means defining a truncated conical shape, and b. a plurality of openings through said wall means disposed in circumferentially spaced relation therein.

5. A compensator as claimed in claim 1 wherein the annular means on said main body element has passage means extending therethrough to provide a fluid flow path through said compensator for the fluid being pumped.

6. A compensator as claimed in claim 1 wherein, a. said main body element has a truncated conical shape, b. a peripheral and axially extending flange connected to the lower end of said main body element, c. a circular channel formed at the upper end of said main body element remote from said flanged end, and d. said resilient means including a plurality of leaf springs connected at their inner ends in said circular groove and extending radially outward therefrom.

7. A compensator as claimed in claim 6 wherein the resilient means include six leaf springs which are equally spaced from each other.

8. In a centrifugal pump including an outer cylindrical casing, a first end casing closing one end of said outer cylindrical casing and a second end casing closing the other end of said outer cylindrical casing remote from said first end casing, and a plurality of interstage pumping assemblies in said outer cylindrical casing between said first end casing and said second end casing, the combination therewith of a compensator including, a. a main body element disposed in assembled position between said second end casing and the end most interstage pumping assembly, b. said main body element having annular means at one end for engaging said end most interstage pumping assembly radially outward of the centerline thereof to maintain concentricity of the compensator with respect to said interstage pumping assemblies when the compensator is exerting forces thereon, c. resilient means connected to the end of said main body element remote from said annular means, and d. resilient means connected to said main body element of the compensator for engagement with said second end casing to bias said annular means whereby said compensator will exert a controlled force against said end most one of said interstage pumping assemblies to permit differential movement of said interstage pumping assemblies while maintaining a fluid seal between the respective interstage pumping assemblies.

9. In the combination as claimed in claim 8 wherein, a. said main body element has wall means having a truncated conical shape, and b. said resilient means are a plurality of radially extending leaf springs having their inner ends connected to the upper end of said main body element and having their outer ends disposed for engagement with the inner force of said second end casing.

10. In the combination as claimed in claim 8 wherein, a. said main body element has wall means having a truncated conical shape, and b. a plurality of openings through said wall means disposed in circumferentially spaced relation therein.

11. In the combination as claimed in claim 8 wherein, a. said main body element has a truncated conical shape, b. a peripheral and axially extending flange connected to the lower end of said main body element, c. a circular channel formed at the upper end of said main body element remote from said flanged end, and d. said resilient means including a plurality of leaf springs connected at their inner ends in said circular groove and extending radially outward therefrom.

12. In the combination as claimed in claim 7 wherein the annular means on said main body element has passage means extending therethrough to provide a fluid flow path through said compensator for the fluid being pumped.

* * * * *